United States Patent [19]

Tsubota et al.

[11] 4,429,031

[45] Jan. 31, 1984

[54] COLOR DIFFUSION TRANSFER PHOTOGRAPHIC ELEMENT

[75] Inventors: Motohiko Tsubota; Masakazu Morigaki; Tsutomu Hamaoka; Nobutaka Ohki, all of Minami-ashigara, Japan

[73] Assignee: Fuji Photo Film Co., Ltd., Kanagawa, Japan

[21] Appl. No.: 193,495

[22] Filed: Oct. 3, 1980

[30] Foreign Application Priority Data

Oct. 3, 1979 [JP] Japan ..... 54-127567

[51] Int. Cl.[3] ..... G03C 5/54

[52] U.S. Cl. ..... 430/218; 430/441; 430/485

[58] Field of Search ..... 430/551, 372, 502, 504, 430/554, 218, 485, 441

[56] References Cited

U.S. PATENT DOCUMENTS

| | | | |
|---|---|---|---|
| 4,201,578 | 5/1980 | Abbott | 430/224 |
| 4,254,216 | 3/1981 | Uchida et al. | 430/372 |
| 4,277,558 | 7/1981 | Kikuchi et al. | 430/372 |

OTHER PUBLICATIONS

Research Disclosure, May 1979, pp. 205–206.

"Photographic Processes & Products" *Research Disclosure,* #15162, 11/76, pp. 76–89.

*Primary Examiner*—John E. Kittle
*Assistant Examiner*—John L. Goodrou
*Attorney, Agent, or Firm*—Sughrue, Mion, Zinn, Macpeak, and Seas

[57] ABSTRACT

A color diffusion transfer photographic element is disclosed, comprising (a) a photosensitive component containing at least one photosensitive silver halide emulsion layer combined with a DRR compound, (b) a dye image receiving component and (c) an alkaline processing composition component, wherein the improvement comprises at least one of said components (a), (b), and (c) containing a compound represented by the formula (I)

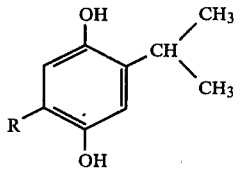

(I)

wherein R represents a substituted or unsubstituted alkyl group having from 1 to 18 carbon atoms.

8 Claims, No Drawings

COLOR DIFFUSION TRANSFER PHOTOGRAPHIC ELEMENT

BACKGROUND OF THE INVENTION

1. Field of the Invention

The present invention relates to color photographic elements and, particularly, to photographic elements for a color diffusion transfer process.

More particularly, it relates to color diffusion transfer photographic elements using a silver halide developing agent capable of cross-oxidizing DRR compounds (the term "DRR" as used hereinafter refers to "dye-releasing redox").

2. Description of the Prior Art

It has been known to use hydroquinones in color diffusion transfer photographic elements. For example, such descriptions thereof appear in U.S. Pat. Nos. 3,537,849, 3,253,915, 3,039,869, 3,192,044, and 3,411,904, etc. The photographic elements described therein are color diffusion transfer photographic elements using a dye developing agent as a dye image-forming material. In greater detail, they are color diffusion transfer photographic elements wherein the dye image-forming material in a reduced state (i.e., the dye developing agent itself) is diffusible in an alkaline medium, but is mordanted in the image-receiving component to form a color image and an oxidized dye developing agent which are non-diffusible. The function of the above-described hydroquinones in such photographic elements is to assist the development of silver halide by the dye developing agent.

On the other hand, in addition to the above-described color diffusion transfer photographic elements, color diffusion transfer photographic elements are also known using as a dye image-forming material a DRR compound capable of releasing a diffusible dye as a result of a redox reaction with an oxidation product of a developing agent caused by development of silver halide. It has been described, for example, in *Research Disclosure,* No. 15162, page 79 (published in November, 1976) that, in such color diffusion transfer photographic elements, certain kinds of hydroquinones hinder cross-oxidation of the oxidation product of the developing agent and the DRR compound to control gradation.

In the present specification, a compound having the above-described function of controlling gradation is called a "competitive developing agent".

There is further description in *Research Disclosure,* No. 15162 that hydroquinone, methylhydroquinone and t-butylhydroquinone are particularly effective as the competitive developing agent. With hydroquinone, methylhydroquinone and t-butylhydroquinone, although an effect of controlling gradation is ascertained, as described therein, sufficient control of the gradation cannot be achieved.

SUMMARY OF THE INVENTION

An object of the present invention is to provide color diffusion transfer photographic elements containing a competitive developing agent having excellent gradation control properties.

Another object of the present invention is to provide a process particularly for controlling gradation of the toe part in a photographic characteristic curve of color diffusion transfer photographs.

The above-described objects have been attained by providing color diffusion transfer photographic elements comprising (a) a photosensitive component containing at least one photosensitive silver halide emulsion layer combined with a DRR compound, (b) a dye image-receiving component and (c) an alkaline processing composition component, wherein at least one of the above-described components (a), (b) and (c) contains a compound represented by the formula (I)

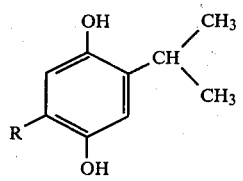

(I)

wherein R represents a substituted or unsubstituted alkyl group having from 1 to 18 carbon atoms.

DETAILED DESCRIPTION OF THE INVENTION

The substituted or unsubstituted alkyl moiety represented by R has from 1 to 18 carbon atoms, and preferably from 1 to 8 carbon atoms, and may be a straight chain or a branched chain group. Examples of the substituents include a hydroxyl group, a halogen atom, a sulfone group, a carboxyl group, an amino group, an alkyloxy group, an alkylthio group, an aryloxy group, an arylthio group, a sulfonamido group, a sulfamoyl group, an alkylamido group, an aldehydo group, and a 3,4-methylenedioxyphenyl group.

Preferred examples of the alkyl group represented by R include a methyl group, an ethyl group, a methoxyethyl group, an n-propyl group, an isopropyl group, an allyl group, an n-butyl group, an isobutyl group, a t-amyl group, an n-octyl group, a t-octyl group, an n-octadecyl group, an n-hexadecyl group, a sec-hexadecyl group, an n-pentadecyl group, an n-octadecyl group, and a sec-octadecyl group.

In the following, examples of the compound represented by the formula (I) used in the present invention are described, but this invention is not limited to these.

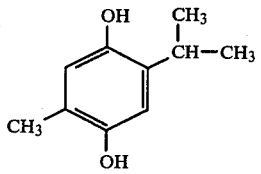

(1)

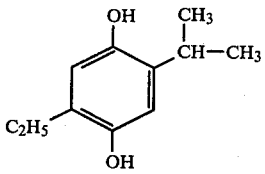

(2)

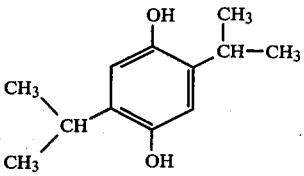

(3)

-continued (4)

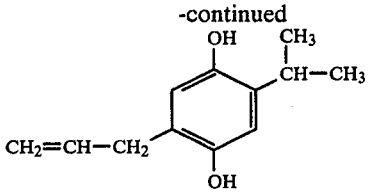

(5)

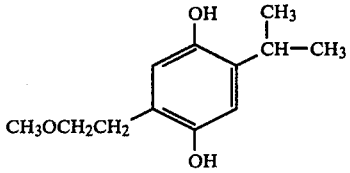

(6)

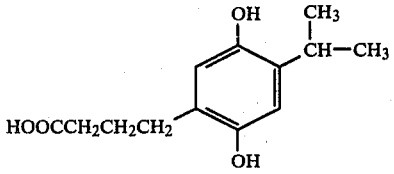

(7)

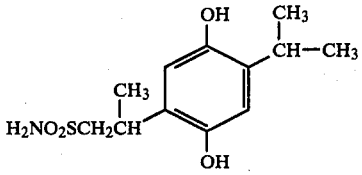

(8)

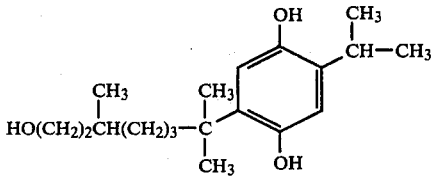

(9)

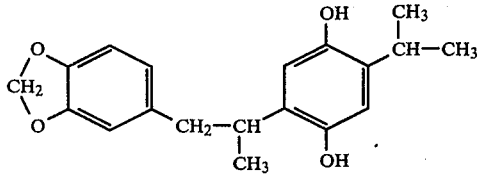

(10)

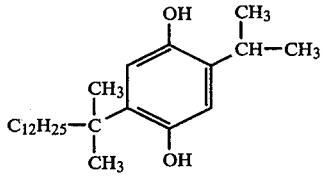

(11)

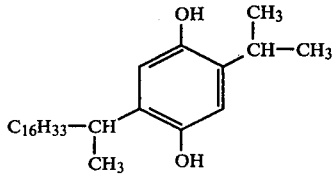

The compounds represented by the formula (I) used in the present invention are known substances, which have been described, for example, in *Organic Syntheses Collective,* Vol. 1, page 511 (1961), a *J. Sci. Research Inst.,* (Tokyo), Vol. 51, pages 180 and 181 (1957), *Zhurnal Obschei Khimi.,* Vol. 32, pages 869 to 873 (1962), U.S.S.R. Pat. No. 129,203, and *Collection of Czechoslovak Chemical Communications,* Vol. 31, pages 98 to 105 (1966), etc. Compounds useful in this invention which are not specifically described in the foregoing literature can be synthesized according to the processes described by appropriate selection of starting materials that would be clear to those skilled in the art.

In the present invention, the compounds represented by the above-described formula (I) can be contained in at least one of the above-described components (a), (b) and (c). However, a preferable embodiment of the present invention is color diffusion transfer photographic elements in which the compounds represented by the formula (I) are contained in the alkaline processing composition component (c).

A more preferred embodiment is the case that the compound represented by the formula (I) wherein R is an alkyl group having from 1 to 8 carbon atoms is contained in the alkaline processing composition component. A preferred amount of compound represented by the formula (I) in the alkaline processing composition component is from about 0.01 to 1 g per kg of the processing composition.

The processing composition comprising the processing composition component used in the present invention is a liquid composition containing processing components necessary to develop silver halide emulsions and to form diffusion transfer images, or dye images which remain after released dyes have diffused. The solvent of such a processing composition is composed mainly of water and may contain hydrophilic solvents such as methanol or 2-methoxyethanol, etc. The processing composition contains alkali in an amount sufficient to maintain a pH required for development of the emulsion layers and to neutralize acids formed during steps of development and dye image formation (for example, hydrohalogenic acids such as hydrobromic acid).

As a silver halide developing agent contained in the processing composition used in the present invention, any silver halide developing agent may be used, provided that it causes cross-oxidation with DRR compounds. This developing agent can be added to the photosensitive element, if desired, because it is only activated by the alkali processing composition when development of silver halide begins substantially.

Examples of such developing agents include 3-pyrazolidinones, for example, 1-phenyl-3-pyrazolidinone, 4,4-dimethyl-1-phenyl-3-pyrazolidinone, 4-hydroxymethyl-4-methyl-1-phenyl-3-pyrazolidinone, 4-hydroxymethyl-4-methyl-1-tolyl-3-pyrazolidinone, 4-hydroxymethyl-4-methyl-1-(4'-methoxy)-3-pyrazolidinone, 4,4-bis(hydroxymethyl)-1-phenyl-3-pyrazolidinone, 4,4-bis(hydroxymethyl)-1-tolyl-3-pyrazolidinone, 4,4-bis(hydroxymethyl)-1-(4'-methoxy)-3-pyrazolidinone, 4,4-dimethyl-1-tolyl-3-pyrazolidinone and 1,5-diphenyl-3-pyrazolidinone, etc.; aminophenols, for example, p-aminophenol, p-methylaminophenol, p-dimethylaminophenol, p-dibutylaminophenol, p-piperidinophenol, and 4-dimethylamino-2,6-dimethoxyphenol, etc.; phenylenediamines, for example, N-methyl-p-phenylenediamine, N-ethyl-p-phenylenediamine, N,N-dimethyl-p-phenylenediamine, N,N-diethyl-p-phenylenediamine, N,N,N',N'-tetramethyl-p-phenylenediamine and 4-diethylamino-2,6-dimethoxyaniline, etc.; and reductones, for example, piperidinohexose reductone and pyrrolidinohexose reductone, etc.

As alkali donative substances in the alkali processing composition used in the present invention, alkali metal hydroxides (for example, sodium hydroxide, potassium hydroxide, rubidium hydroxide and cesium hydroxide, etc.) can be used.

Furthermore, sodium carbonate and amines such as diethylamine can be used. The alkaline processing composition preferably has a pH of 11 or more by means of these alkali donative substances.

It is preferred that the alkaline processing composition used in the present invention contain viscosity increasing compounds. Examples of such viscosity increasing compounds include ethers inactive to alkaline solutions, such as alkali metal salts of hydroxyethyl cellulose or carboxymethyl cellulose (for example, sodium carboxymethyl cellulose). An advantageous amount thereof is from 1 to 10% by weight of the processing composition. The viscosity is preferred to be from about 100 to 200,000 cps. Accordingly, in addition to the above-described viscosity increasing compounds, it is possible to use polysaccharide gums such as guar gums, xanthans and Algins as described in *Research Disclosure,* No. 15162 November, 1976) as the viscosity increasing compounds.

It is preferred that the alkaline processing composition used in the present invention contain light-shielding agents. For example, carbon black, titanium dioxide, and light absorbing dyes, for example, indicator dyes, etc., can be used. It is preferred that the indicator dyes be those which are transparent when exposed to light, but which develop the color or become opaque when brought into contact with alkali from the processing composition.

Further, the photographic elements of the present invention may contain various other known compounds for particular purposes. However, it is preferred to such to the alkaline processing composition.

The photographic elements of the present invention may contain additives in order to increase maximum transfer image densities ($D_{max}$). For example, aromatic alcohols such as benzyl alcohol and p-xylene-$\alpha,\alpha'$-diols as described in U.S. Pat. No. 3,846,129, can be used for this purpose.

Further, aliphatic or alicyclic glycols and saturated aliphatic or alicyclic aminoalcohols as described in U.S. Pat. No. 4,030,920, for example, 1,4-cyclohexanedimethanol, 1,6-hexanediol, 3-amino-1-propanol, 2-amino-1-propanol, 5-amino-1-pentanol, 6-amino-1-hexanol and 2-amino-2-methyl-1-propanol, etc., can also be used for this purpose.

As other compounds for increasing $D_{max}$, there are colloidal silica and potassium iodide as described in *Research Disclosure,* No. 15162 (November, 1976).

The photographic elements of the present invention may contain compounds, as described in U.S. Pat. No. 3,942,987, in order to prevent the occurrence of pimple-like deformations after the substantial conclusion of development. These include, for example, alkali metal fluorides and oxalates and barium salts.

In the photographic elements of the present invention, it is possible to control gradation by using together competitive developing agents as described, for example, in *Research Disclosure,* 15162 (November, 1976). There are, for example, hydroquinone, methylhydroquinone and t-butylhydroquinone, as described already in the above.

The photographic elements of the present invention may contain compounds as described in U.S. Pat. No. 2,497,917, such as, for example, 5-methylbenzotriazole, 5,6-dichlorobenzotriazole, 6-nitrobenzimidazole, histidine, etc.

In the alkaline processing composition used in the present invention, pigments such as carbon black or titanium dioxide, etc., are often dispersed uniformly. In this case, known dispersion assistants and surface active agents can be used. There are, for example, alkali metal salts of polyacrylic acid, naphthalenesulfonic acid, a polycondensate of naphthalenesulfonic acid and formaldehyde, and polystyrenesulfonic acid, etc. In order to change various impurities contained in carbon black into substantially harmless substances for silver halide emulsions, the processing composition may contain compounds such as, for example, lead oxide, tin oxide, cadmium oxide, zinc oxide and mercury oxide.

The above-described compounds used as competitive developing agents of the present invention have an excellent gradation controlling function as compared with the known hydroquinone, methylhydroquinone, and t-butylhydroquinone compounds, by which the toe part of the characteristic curve becomes of high contrast. An improvement in color reproduction is observed due to the improvement of gradation of the toe part.

Further, though the above-described hydroquinones such as hydroquinone, methylhydroquinone and t-butylhydroquinone cause severe reduction of the transfer image density ($D_{max}$) when it is intended to substantially control the gradation of the toe part, the compounds of the present invention produce a desired gradation with less reduction of the transfer image density.

It is surprising that a preferred effect of controlling gradation could be obtained by use of the compounds of the present invention, because the effect could not be obtained when known 2,5-di-substituted hydroquinones such as 2,5-dimethylhydroquinone, 2,5-dimethoxyhydroquinone, 2-methyl-5-t-butylhydroquinone and 2,5-dibromohydroquinone were used.

Although the mechanism of the favorable effect in the present invention is not fully understood, it is believed that the isopropyl group substituted on the 2-position (or 5-position) with respect to the hydroxyl group acts advantageously on the mechanism of producing the hydroquinone form from the quinone form. That is, it is believed that, in the compounds of the present invention, the hydroquinone form is produced from the quinone form without forming the so-called hydroxyhydroquinone form having substituents on the nucleus.

The DRR compounds used in the present invention can be represented by the formula (II)

$$Y—D \qquad \text{(II)}$$

wherein Y represents a group which releases the diffusible dye D (or precursor thereof) by decomposition of the DRR compound as a result of reaction, which is called a "redox center". Generally, Y has a "ballast group" for rendering the DRR compound nondiffusible. D may be a dye itself or may be the dye and a group for linking the dye to Y. Typical examples of such dyes include azo dyes. An effective example of Y is an N-substituted sulfamoyl group. Examples of Y include groups represented by the formula (A)

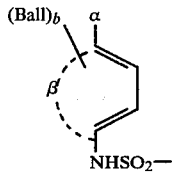

(A)

In the formula, $\beta$ represents a non-metal atomic group necessary to form a benzene ring which may condense with a carbocyclic or heterocyclic ring, such as a naphthalene ring, a quinoline ring, a 5,6,7,8-tetrahydronaphthalene ring or a coumarone ring, etc. Further, the above-described benzene ring or ring formed by condensation of the benzene ring with the carbon ring or the hetero ring may be substituted by halogen atoms, alkyl groups, alkoxy groups, aryl groups, aryloxy groups, nitro groups, amino groups, alkylamino groups, arylamino groups, amido groups, cyano groups, alkylmercapto groups, keto groups, carboalkoxy groups or heterocyclic groups, etc.

$\alpha$ represents a group represented by $-OG^1$ or $-NHG^2$, wherein $G^1$ represents hydrogen or a group which forms a hydroxyl group by hydrolysis, and, preferably, it represents hydrogen or a group represented by $$-\overset{O}{\overset{\|}{C}}G^3 \text{ or } -\overset{O}{\overset{\|}{C}}-O-G^3$$

wherein $G^3$ represents an alkyl group, particularly, an alkyl group having from 1 to 18 carbon atoms such as a methyl group, an ethyl group, or a propyl group, a halogen-substituted alkyl group having from 1 to 18 carbon atoms such as a chloromethyl group or a trifluoromethyl group, a phenyl group or a substituted phenyl group. Further, $G^2$ represents hydrogen, an alkyl group having from 1 to 22 carbon atoms or a group capable of hydrolyzing. A preferred group capable of hydrolyzing represented by $G^2$ is the group represented by $$-\overset{O}{\overset{\|}{C}}G^4,$$

$-SO_2G^5$ or $-SOG^5$, wherein $G^4$ represents an alkyl group having from 1 to 4 carbon atoms such as a methyl group, a halogen-substituted alkyl group such as a mono-, di- or trichloromethyl group or a trifluoromethyl group, an alkylcarbonyl group such as an acetyl group, an alkyloxy group, a substituted phenyl group such as a nitrophenyl group or a cyanophenyl group, a phenyloxy group unsubstituted or substituted with lower alkyl groups or halogen atoms, a carboxyl group, an alkyloxycarbonyl group, an aryloxycarbonyl group, an alkylsulfonylethoxy group or an arylsulfonylethoxy group, and $G^5$ represents a substituted or unsubstituted alkyl group or aryl group.

Further, b is 0 or an integer of 1 or 2. But except in the case that $\alpha$ contains, as $G^2$ in $-NHG^2$, a group corresponding to the alkyl group which makes the compound represented by the above-described formula (A) immovable and non-diffusible, namely, when $\alpha$ is the group represented by $-OG^1$ or the group $-NHG^2$ wherein $G^2$ represents hydrogen, an alkyl group having from 1 to 8 carbon atoms or a group capable of hydrolyzing, b is 1 or 2 and preferably 1. Ball represents a ballast group. Such ballast group is illustrated in detail in the following.

Examples of this kind of Y and DRR compounds have been described in Japanese Patent Application (OPI) Nos. 33826/73 (the term "OPI" as used herein refers to a "published unexamined Japanese patent application") and 50736/78. Another example of Y suitable for such compounds includes the group represented by the following formula (B)

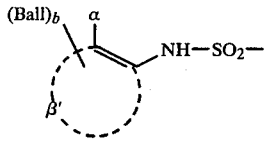

(B)

In the formula (B), Ball, $\alpha$, and b each has the same meaning as in the case of the formula (A), and $\beta'$ represents an atomic group necessary to form a carbocyclic ring such as a benzene ring which may condense with a carbocyclic or heterocyclic ring to form a naphthalene ring, a quinoline ring, a 5,6,7,8-tetrahydronaphthalene ring, a coumarone ring, etc. Further, the above-described rings may be substituted by halogen atoms, alkyl groups, alkoxy groups, aryl groups, aryloxy groups, nitro groups, amino groups, alkylamino groups, arylamino groups, amido groups, cyano groups, alkylmercapto groups, keto groups, carboalkoxy groups or heterocyclic groups, etc. Examples of this kind of Y and DRR compounds have been described in Japanese Patent Application No. 91187/79, Japanese Patent Application (OPI) No. 113624/76 and U.S. Pat. No. 4,053,312. A further example of Y suitable for this type of compound includes the group represented by the following formula (C)

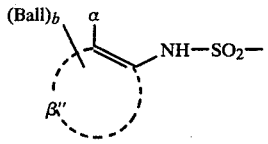

(C)

In the formula (C), Ball, $\alpha$, and b each has the same meaning as in the case of the formula (A) and $\beta''$ represents an atomic group necessary to form a heterocyclic ring such as a pyrazole ring or a pyridine ring, etc., which may condense with a carbocyclic ring or a heterocyclic ring. Further, these rings may be substituted by the same kinds of substituents as those described in the formula (B). Examples of this kind of Y and DRR compounds have been described in Japanese Patent Application (OPI) No. 104343/76.

A further example of Y effective for this type of compound includes the group represented by the formula (D)

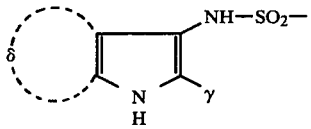

(D)

In the formula (D), $\gamma$ represents preferably hydrogen, an alkyl, aryl or heterocyclic group which has substituents or is not substituted, or $-CO-G^6$ wherein $G^6$ represents $-OG^7$, $-S-G^7$ or

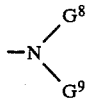

(wherein $G^7$ represents hydrogen, an alkyl group, a cycloalkyl group or an aryl group, wherein the alkyl group, the cycloalkyl group and the aryl group may have substituents, $G^8$ represents the same groups as $G^7$, or $G^8$ represents an acyl group derived from an aliphatic or aromatic carboxylic acid or sulfonic acid, and $G^9$ represents hydrogen or an unsubstituted or substituted alkyl group), $\delta$ represents a residue necessary to complete a condensed benzene ring which may have one or more substituents, and the substituents on the condensed benzene ring in $\gamma$ and/or $\delta$ are ballast groups or groups containing a ballast group. Examples of this kind of Y and DRR compounds have been described in Japanese Patent Application (OPI) Nos. 104343/76 and 46730/78.

Further, an example of Y suitable for this type of compound includes the group represented by the formula (E)

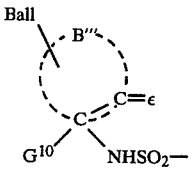

(E)

In the formula (E), Ball has the same meaning as the case of the formula (A), $\epsilon$ represents an oxygen atom or the group =NG'' (G'' represents a hydroxyl group or an amino group which may have substituents). Particularly, in the case where $\epsilon$ is the group =NG'', a typical example of G'' is that in the group =C=N—G'' formed by a dehydration reaction of a carbonyl reagent represented by $H_2N$—G'' with a ketone group. As the compound $H_2N$—G'' in this case, there are, for example, hydroxylamine, hydrazines, semicarbazides and thiosemicarbazides. Examples of hydrazines include hydrazine, phenylhydrazine, substituted phenylhydrazines having substituents such as alkyl groups, alkoxy groups, carboalkoxy groups or halogen atoms, etc., and isonicotinic acid hydrazide. Examples of the semicarbazides include phenyl semicarbazide and substituted phenyl carbazides having substituents such as alkyl groups, alkoxy groups, carboalkoxy groups, or halogen atoms, etc. Examples of semithiocarbazides include various derivatives similar to those of semicarbazides.

Further, $\beta'''$ in the formula represents a 5-member, 6-member or 7-member saturated or unsaturated nonaromatic hydrocarbon ring. Typical examples of the ring include cyclopentanone, cyclohexanone, cyclopentenone, cycloheptanone and cycloheptenone.

Furthermore, the 5-, 6- or 7-member nonaromatic hydrocarbon ring may form a condensed ring by condensing with another ring in suitable positions thereof. The above-described another ring may be aromatic or not aromatic which may be any of a hydrocarbon ring and a heterocyclic ring. In the case of forming a condensed ring, it is more preferred in the present invention that the condensed ring is formed by condensation of benzene with the above-described 5-, 6- or 7-member nonaromatic hydrocarbon ring, such as indanone, benzocyclohexenone or benzocycloheptenone, etc.

The above-described 5-, 6- or 7-member nonaromatic hydrocarbon ring and the above-described condensed rings may have one or more substituents such as alkyl groups, aryl groups, alkyloxy groups, aryloxy groups, alkylcarbonyl groups, arylcarbonyl groups, alkylsulfonyl groups, arylsulfonyl groups, halogen atoms, a nitro group, an amino group, alkylamino groups, arylamino groups, amido groups, alkylamido groups, arylamido groups, a cyano group, alkylmercapto groups and alkyloxycarbonyl groups, etc. $G^{10}$ represents hydrogen or a halogen atom such as fluorine, chlorine or bromine. Examples of this kind of Y and DRR compounds have been described in Japanese Patent Application (OPI) No. 3819/78.

Other examples of Y in the DRR compounds have beend described in Japanese Patent Publication Nos. 32129/73 and 39165/73, Japanese Patent Application (OPI) No. 64436/74 and U.S. Pat. No. 3,443,943.

Other kinds of compounds represented by the formula (II) are nondiffusible image-forming compounds which release a diffusible dye by self-ring closure under an alkaline condition but do not substantially release the dye when reacted with a developing agent oxidized product.

An example of Y effective for this kind of compound includes the group represented by the formula (F)

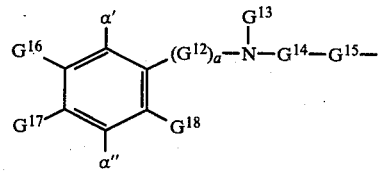

(F)

In the formula (F), $\alpha'$ is a nucleophilic group capable of oxidizing, such as a hydroxyl group, a primary or secondary amino group, a hydroxyamino group or a sulfonamido group, etc., or a precursor thereof, and the hydroxyl group is preferred.

$\alpha''$ is a dialkylamino group or a group defined in $\alpha'$, and the hydroxyl group is preferred. $G^{14}$ represents an electrophilic group such as —CO— or —CS—, and —CO— is preferred. $G^{15}$ represents an oxygen atom, a sulfur atom, a selenium atom or a nitrogen atom, which may be substituted by hydrogen, an alkyl or a substituted alkyl group having from 1 to 10 carbon atoms or an aromatic residue having from 6 to 20 carbon atoms. A preferred $G^{15}$ is an oxygen atom. $G^{12}$ represents an alkylene group having from 1 to 3 carbon atoms a is 0 or 1, preferably 0. $G^{13}$ represents a substituted or unsubstituted alkyl group having from 1 to 40 carbon atoms or a substituted or unsubstituted aryl group having from 6 to 40 carbon atoms, preferably an alkyl group. $G^{16}$, $G^{17}$ and $G^{18}$ represent each hydrogen, a halogen atom, a carbonyl group, a sulfamoyl group, a sulfonamido group, an alkyloxy group having from 1 to 40 carbon atoms or the same group as $G^{13}$, wherein $G^{16}$ and $G^{17}$ may form a 5-, 6-, or 7-member ring each other. Further, $G^{17}$ may be $$-(G^{12})_a-\overset{G^{13}}{\overset{|}{N}}-G^{14}-G^{15}-.$$

At least one of $G^{13}$, $G^{16}$, $G^{17}$ and $G^{18}$ should represent a ballast group. Examples of this kind of Y and DRR compounds are described in Japanese Patent Application (OPI) No. 63618/76.

A further example of Y suitable for this kind of compound includes the group represented by the formula (G)

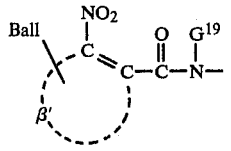

(G)

In the formula (G), Ball and $\beta'$ each has the same meaning as in the formula (B), and $G^{19}$ represents an alkyl group (including a substituted alkyl group).

Examples of this kind of Y and DRR compound have been described in Japanese Patent Application (OPI) No. 35533/78.

A further example of Y suitable for this kind of compound includes the group represented by the formula (H)

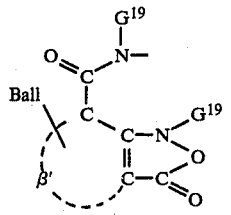

(H)

In the formula (H), Ball and $\beta'$ each has the same meaning as in the formula (B) and $G^{19}$ is the same as formula (G). Examples of this kind of Y and DRR compounds have been described in Japanese Patent Application (OPI) Nos. 111628/74 and 4819/77.

The ballast group is an organic ballast group capable of making the DRR compound nondiffusible during development in an alkaline processing solution, and preferably contains a hydrophobic group having from 8 to 32 carbon atoms. The organic ballast group links to the DRR compound directly or through a linking group (for example, an imino bond, an ether bond, a thioether bond, a carbonamido bond, a sulfonamido bond, a ureido bond, an ester bond, an imido bond, a carbamoyl bond, a sulfamoyl bond and combinations thereof).

Examples of the ballast group include alkyl groups and alkenyl groups (for example, a dodecyl group and an octadecyl group), alkoxyalkyl groups (for example, a 3-(octyloxy)propyl group and a 3-(2-ethylundecyloxy)-propyl group as described in Japanese Patent Publication No. 27563/64), alkylaryl groups (for example, a 4-nonylphenyl group and a 2,4-di-tert-butylphenyl group), alkylaryloxyalkyl groups (for example, a 2,4-di-tert-pentylphenoxymethyl group, an α-(2,4-di-tert-pentylphenoxy)propyl group and a 1-(3-pentadecylphenoxy)ethyl group), acylamidoalkyl groups (for example, groups as described in U.S. Pat. Nos. 3,337,344 and 3,418,129, and a 2-(N-butylhexadecanamido)ethyl group), alkoxyaryl and aryloxyaryl groups (for example, a 4-(n-octadecyloxy)phenyl group and a 4-(4-dodecylphenyloxy)phenyl group, etc.), residues having a long chain alkyl or alkenyl group and a water solubilizing group such as a carboxyl or sulfo group (for example, a 1-carboxymethyl-2-nonadecenyl group and a 1-sulfoheptadecyl group, etc.), alkyl groups substituted by an ester group (for example, a 1-ethoxycarbonylheptadecyl group and a 2-(n-dodecyloxycarbonyl)ethyl group, etc.), alkyl groups substituted by an aryl group or a heterocyclic group (for example, a 2-[4-(3-methoxycarbonylheneicosanamido)phenyl]ether group and a 2-[4-(2-n-octadecylsuccinimido)phenyl]ethyl group, etc.) and aryl groups substituted by an aryloxyalkoxycarbonyl group (for example, a 4-[2-(2,4-di-tert-pentylphenyloxy)-2-methylpropyloxycarbonyl]phenyl group, etc.).

Among the above-described organic ballast groups, particularly preferred are those which link through a linking group, as represented by the following formulae.

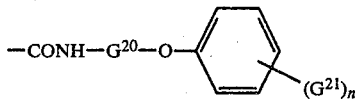

$-CONH-G^{20}-O-C_6H_4-(G^{21})_n$ $-CONH-G^{20}-O-G^{22}$
$-O-G^{23}$
$-CONHG^{22}$

In these formulae, $G^{20}$ represents an alkylene group having from 1 to 10 carbon atoms and, preferably, from 1 to 6 carbon atoms, for example, a propylene group or a butylene group, $G^{21}$ represents hydrogen or an alkyl group having from 1 to 10 carbon atoms and, preferably, from 1 to 6 carbon atoms (for example, a tert-amyl group), n represents an integer of from 1 to 5 (preferably 1 or 2), $G^{22}$ represents an alkyl group having from 4 to 30 carbon atoms and, preferably, from 10 to 20 carbon atoms, for example, a dodecyl group, a tetradecyl group or a hexadecyl group, and $G^{23}$ represents an unsubstituted alkyl group having from 8 to 30 carbon atoms and, preferably, from 10 to 20 carbon atoms (for example, a hexadecyl group or an octadecyl group, etc.) or a substituted alkyl group having 8 or more carbon atoms (wherein the alkyl residue has 1 or more carbon atoms, and an example of the substituent is a carbamoyl group).

Further, DRR compounds that can be used in the present invention in addition to those described in the above-described patent specifications, there are 1-hydroxy-2-tetramethylenesulfamoyl-4-[3'-methyl-4'-(2''-hydroxy-4''-methyl-5''-hexadecyloxyphenylsulfamoyl)phenylazo]naphthalene as a magenta dye image-forming substance, and 1-phenyl-3-cyano-4-{3'-[2''-hydroxy-4''-methyl-5''-(2''',4'''-di-t-pentylphenoxyacetamino)phenylsulfamoyl]phenylazo}-5-pyrazolone as a yellow dye image-forming substance.

The DRR compounds used in the present invention are dispersed in hydrophilic colloids as carriers by the following method. Namely, a solution obtained by dissolving a DRR compound in an organic solvent is added to a solution of a hydrophilic colloid to disperse therein a fine drops. In cases where the solvent is easily volatilized, such as ethyl acetate, tetrahydrofuran or methyl ethyl ketone, it can be removed in a drying step of the photographic layer or by a method as described in U.S. Pat. Nos. 2,322,027 and 2,801,171. In the case wherein it is soluble in water, such as dimethylformamide or 2-methoxyethanol, it can be removed by washing with water according to methods such as those described in U.S. Pat. Nos. 2,949,360 and 3,396,027, etc. However, in order to stabilize dispersion of the DRR compound and to accelerate dye image formation, it is advantageous that the DRR compound is incorporated in a solvent which is substantially insoluble in water and has a 200° C. or more boiling point under normal pressure. Examples of such solvents include dibutylphthalate, tricresyl phosphate, trihexyl phosphate and N,N-diethyllauramide, etc. In order to accelerate dissolution of the DRR compound, it is suitable to use the above-described volatile or water-soluble solvent as an auxiliary solvent.

Instead of or in addition to the above-described high boiling point solvent, it is possible to use oleophilic polymers. As the oleophilic polymers suitable for this purpose, there are polyester resins obtained by polycondensation of polyhydric alcohols with polybasic acids. As other polymers, it is possible to use, for example, polyvinylpyrrolidone, polyvinyl acetate, polyvinyl propionate, polyvinyl butyral, polyvinyl chloride, polyacrylates, polymethacrylates, nitrocarboxymethyl cellulose, N-vinylpyrrolidone-acrylic acid copolymer, N-vinylpyrrolidone-acrylic acid-methyl acrylate copolymer, vinyl phthalimide-acrylic acid copolymer, cellulose acetate hydrogen phthalate, poly-N-methyl methacrylamide and dimethylaminoethyl methacrylate-acrylic acid copolymer, etc.

Generally, a colloid mill, a high-pressure homogenizer, an ultrasonic emulsification device or a high-speed revolving mixer, etc., is used for dispersing the emulsion into fine liquid drops. Further, anion surface active agents are preferably used as emulsification assistants.

As surface active agents useful for dispersion of the DRR compounds used in the present invention, there are sodium triisopropyl naphthalenesulfonate, sodium dinonylnaphthalenesulfonate, sodium p-dodecylbenzenesulfonate, sodium dioctylsulfosuccinate, sodium cetyl sulfate and anion surface active agents as described in Japanese Patent Publication No. 4293/64 and British Pat. No. 1,138,514. Use of these anion surface active agents with higher aliphatic acid esters brings a particularly excellent emulsification effect as described in U.S. Pat. No. 3,676,141. Further, dispersion processes as described in Japanese Patent Publication No. 13837/68 and U.S. Pat. Nos. 2,992,104, 3,044,873, 3,061,428 and 3,832,173, etc., are effective for dispersing the compounds of the present invention.

Examples of hydrophilic colloids used for dispersing the DRR compounds of the present invention include gelatin, colloidal albumin, casein, cellulose derivatives such as carboxymethyl cellulose or hydroxyethyl cellulose, etc., agar, sodium alginate, sugar derivatives such as starch derivatives, etc., and synthetic hydrophilic colloids, for example, polyvinyl alcohol, poly-N-vinylpyrrolidone, acrylic acid copolymer, polyacrylamide and derivatives and partially hydrolyzed products thereof, etc. If desired, two or more of these colloids are used as a compatible mixture. Among them, though gelatin is the most commonly used one, a part or the whole of it may be substituted by synthetic high molecular substances.

In the color diffusion transfer photosensitive component of the present invention, silver halide emulsions are combined with the DRR compounds.

The silver halide emulsions used in the present invention are hydrophilic colloid dispersions of silver chloride, silver bromide, silver chlorobromide, silver iodobromide, silver chloroiodobromide or a mixture thereof. The halogen component is decided according to the purpose of use and processing conditions of the photosensitive material, but it is generally preferred to use silver iodobromide (iodide content is 1% by mol to 10% by mol and chloride content is 30% by mol or less), silver bromide, and silver chloroiodobromide emulsions. The silver halide to be used may be any of those having a common particle size or those having a fine particle size, but it is preferred to use those having an average particle size in the range of from about 0.1 micron to about 2 microns. Further, the photosensitive material is sometimes preferred to have a uniform particle size according to the purpose of use. The crystal form of particles to be used may be any of the cubic form, octahedral form, and mixed crystal form. These silver halide emulsions can be produced by known conventional processes as described, for example, in *Chemie Photographique,* written by P. Glafkides (2nd Edition, 1957, Paul Montel, Paris), Chapters 18 to 23. It is preferred that the silver halide emulsions used in the present invention are chemically sensitized such as with natural sensitizers contained in gelatin, sulfur sensitizers, such as sodium thiosulfate or N,N,N'-triethylthiourea, gold sensitizers, such as thiocyanate complexes or thiosulfate complexes of monovalent gold or reducing sensitizers, such as stannous chloride or hexamethylenetetramine. In the present invention, it is also possible to use emulsions wherein latent images are easily formed on the surface of particles. Furthermore, it is possible to use not only inner latent image type emulsions as described in U.S. Pat. Nos. 2,592,550 and 3,206,313, but also direct reversal emulsions using desensitizing dyes and solarization type emulsions.

As the above-described solarization type emulsions, emulsions described in *The Theory of the Photographic Process,* edited by Mees (1942, Macmillan Co., New York), pages 261 to 297 are useful. Processes for preparing them have been described, for example, in British Pat. Nos. 443,245 and 462,730 and U.S. Pat. Nos. 2,005,837, 2,541,472, 3,367,778, 3,501,305, 3,501,306 and 3,501,307.

The inner latent image type silver halide emulsions advantageously used in the present invention are those which have sensitivity specks in the inner part of silver halide emulsion particle, by which latent images are selectively formed in the inner part of the particles when exposed to light, while the degree of latent image formation on the surface of the particles is small. Such inner latent image type silver halide emulsions are characterized by the silver content of images obtained by developing using a surface developing solution (corresponding to surface latent images) according to the process described in *The Theory of Photographic Process* (4th Edition, 1977, edited by T. H. James), pages 171 to 176, after exposure to light, is lower than the silver content of images obtained by developing using an internal developing solution (corresponding to the whole latent image). The inner latent image type silver halide emulsions can be produced by various processes. Examples thereof include Burton emulsions produced by an ammonia process (*Photographic Emulsions,* written by E. J. Wall, pages 35 and 36, and 52 and 53, American Photographic Publishing Co., (1929) and U.S. Pat. Nos. 2,497,875 and 2,563,785), primitive emulsions containing large particles having a low iodine content produced by an ammonia process (German Patent Application (OLS) No. 2,728,108), emulsions which are produced by rapidly reducing the ammonia concentration of a solution of silver halide-ammonia complex salt to precipitate silver halide particles (U.S. Pat. No. 3,511,662), conversion emulsions produced by a precipitation process which comprises previously preparing particles of silver salt having high solubility such as silver chloride and converting said silver salt into silver salt having low solubility such as silver bromide or iodide (U.S. Pat. No. 2,592,250), core-shell emulsions produced by a process which comprises mixing a core emulsion of chemically sensitized large particles with an emulsion of fine particles and aging the mixture to cover the core particles with a shell of silver halide (U.S. Pat. No. 3,206,313 and British Pat. No. 1,011,062), core-shell emulsions produced by a process which comprises covering core particles with a shell of silver halide by adding a solution of soluble silver salt and a solution of soluble halide at the same time to a chemically sensitized monodispersion core emulsion so as to keep the silver ion concentration at a fixed value (British Pat. No. 1,027,146 and U.S. Pat. No. 3,761,276), regional halogen emulsions in which emulsified particles have a laminar construction composed of 2 or more layers and the halogen composition of the first phase is different from that of the second phase (U.S. Pat. No. 3,935,014) and emulsions produced by forming silver halide particles in an acid medium containing trivalent metal ions to incorporate a different metal therein (U.S. Pat. No. 3,447,927), etc.

As typical fogging agents for these emulsions, there are hydrazines as described in U.S. Pat. Nos. 2,588,982 and 2,563,785, hydrazides and hydrazones as described in U.S. Pat. No. 3,227,552, and quaternary salt compounds as described in British Pat. No. 1,283,835, Japanese Patent Publication No. 38164/74 and U.S. Pat. Nos. 3,734,738, 3,719,494 and 3,615,615.

Further, in the case of a DIR reversal emulsion in a process as described in U.S. Pat. Nos. 3,227,551, 3,227,554 and 3,364,022 or a reversal emulsion process by dissolution physical development as described in British Pat. No. 904,364, the compounds used in the present invention may be used.

The silver halide emulsions used in the present invention may be stabilized with additives such as 4-hydroxy-6-methyl-1,3,3a,7-tetrazaindene, 5-nitroimidazole, 1-phenyl-5-mercaptotetrazole, 8-chloro-mercury quinoline, benzenesulfinic acid, pyrocatechin, 4-methyl-3-sulfoethylthiazolidine-2-thione or 4-phenyl-3-sulfoethylthiazolidine-2-thione. In addition to them, inorganic compounds such as cadmium salts, mercury salts or complex salts of platinum group elements such as chloro complex salts of palladium, etc., are useful for stabilizing the photosensitive materials of the present invention. Further, the silver halide emulsions used may contain sensitizing compounds such as polyethylene oxide compounds.

The silver halide emulsions used in the present invention are capable of having, if necessary, expanded spectral sensitivity caused by spectral sensitizing dyes. Effective spectral sensitizers include cyanines, merocyanines, holopolar cyanines, styryls, hemicyanines, oxonols and hemioxonols, etc.

Concrete examples of the spectral sensitizers have been described in the above-described text of P. Glafkides: Chapters 35 to 41 and in *The Cyanine and Related Compounds,* by F. M. Hamer (Interscience Co.). Particularly, cyanines wherein the nitrogen atom in the basic heterocyclic group is substituted by an aliphatic group (for example, an alkyl group) having a hydroxyl group, a carboxyl group or a sulfo group, for example, those described in U.S. Pat. Nos. 2,503,776, 3,459,553 and 3,177,210, are especially preferred for practicing the present invention.

The photosensitive component in the color diffusion transfer photosensitive materials according to the present invention is applied to flat materials which do not cause remarkable dimensional deformation during the processing, for example, cellulose acetate films, polystyrene fulms, polyethylene terephthalate films and polycarbonate films conventionally used for photosensitive materials, laminates thereof and thin glass films, etc.

If the adhesion of the photographic emulsion layer to the base is insufficient, a layer which is adhesive to both of them can be provided as a subbing layer. Furthermore in order to more improve the adhesion, the surface of the bases may be subjected to preliminary treatment such as corona discharging, ultraviolet ray application or flame treatment, etc.

In addition, paper and water impermeable laminated paper produced by coating the surface of paper with a polymer such as polyethylene, etc. can be used.

The DRR compounds of the present invention can be utilized for conventional sensitive materials. Particularly, they can be used for color diffusion transfer photosensitive materials. In this case, it is possible to use processes as described in Japanese Patent Publication No. 16356/71, Japanese Patent Application (OPI) No. 33630/76 and U.S. Pat. No. 3,594,164 as processes for composing laminates of the photosensitive materials.

In the photosensitive component capable of use in the present invention, the silver halide emulsions are combined with the DRR compounds. Combinations of spectral sensitivity of the silver halide emulsions and spectral absorption of dye images are suitably selected according to the desired color reproduction. In order to reproduce natural color by a subtractive process, a photosensitive component comprising at least two combinations of an emulsion having selective spectral sensitivity in a certain wavelength range and a compound which produces a dye image having selective spectral absorption in the same wavelength range as described are used. Particularly, a photosensitive component comprising a combination of a blue-sensitive silver halide emulsion and a yellow DRR compound, a combination of a green-sensitive emulsion and a magenta DRR compound and a combination of a red-sensitive emulsion and a cyan DRR compund is preferred for use. These units of the combinations of emulsions and DRR compounds may be applied laminarly so as to be in a face-to-face relation in the photosensitive component or may be applied as a monolayer composed of a mixture of granular units. In a preferred layer construction, a combination unit of a blue-sensitive emulsion, a combination unit of a green-sensitive emulsion and a combination unit of a red-sensitive emulsion are superposed in this order on the exposing side. Particularly, in the case of using a silver iodide containing high speed emulsion, it is preferred to dispose a yellow filter layer between the combination unit of the blue-sensitive emulsion and the combination unit of the green-sensitive emulsion. The yellow filter contains a yellow colloidal silver dispersion, an oil-soluble yellow dye dispersion, acid dye mordanted on a basic polymer or basic dye mordanted on an acid polymer. It is advantageous that the combination units of emulsions are separated from each other by an intermediate layer. The intermediate layer prevents an undesirable interaction occurring between combination units having each different spectral sensitivity. The intermediate layer is composed of, for example, hydrophilic polymers such as gelatin, polyacrylamine or a partially hydrolyzed product of polyvinyl acetate, polymers having fine openings formed from a hydrophilic polymer and a hydrophobic polymer as described in U.S. Pat. No. 3,625,685, or polymers the hydrophilic property of which gradually increases by a processing composition, such as calcium alginate, as described in U.S. Pat. No. 3,384,483.

In order to prevent diffusion of an oxidation product of the developing agent into other combination units of the spectral sensitive emulsion, compounds having a function of trapping the oxidation product (for example, stain preventing agents such as 2,5-di(sec-dodecyl)hydroquinone) may be added to the above described intermediate layer.

The DRR compounds used in the present invention are used in such an amount that the molar ratio of silver of the silver halide emulsion combined therewith to the DRR compound is in the range of from about 50/1 to to 0.5/1 and preferably from about 10/1 to 2/1.

The dye receiving component should have a mordanting layer composed of, for example, poly-4-vinylpyridine latex (in, e.g., polyvinyl alcohol) as described in U.S. Pat. No. 3,148,061, polyvinylpyrrolidone as described in U.S. Pat. No. 3,003,872 or quaternary ammonium salt containing polymers as described in U.S. Pat. No. 3,239,337. As mordanting agents other than the above described materials, basic polymers as described in U.S. Pat. Nos. 2,882,156, 3,625,694 and 3,709,690, etc. are also effectively used. Further, mordanting agents as described in U.S. Pat. Nos. 2,484,430, 3,271,147, 3,184,309 and 3,271,147, etc. can be effectively used.

The photographic elements of the present invention are preferred to have a function of neutralizing alkalis carried by the processing composition. The processing composition contains alkalis for the purpose of giving a high pH sufficient to accelerate the "image forming step" comprising development of the silver halide emulsions and diffusion of the DRR compounds, preferably, 11 or more. After substantial conclusion of formation of the diffusion transfer images, the pH in the film unit is neutralized to near neutral value, namely, less than 9 and preferably less than 8, to substantially stop the image forming step, by which the change of image tone by the lapse of time is prevented and discoloration or fading of images and staining of white areas caused by high alkalinity are repressed. For this purpose, it is advantageous that the film unit be provided with a neutralization layer containing an acidic substance in an amount sufficient to neutralize alkalis in the processing solution to the above described pH, namely, acid substances having an area concentration equivalent to or higher than that of alkalis in the spread processing solution. Preferred acidic substances include substances containing acid groups (or precursor groups forming acid groups by hydrolysis) having a pKa of 9 or less. More preferred examples include higher aliphatic acids such as oleic acid as described in U.S. Pat. No. 2,983,606, and polymers of acrylic acid, methacrylic acid or maleic acid and partial esters or acid anhydrides thereof as described in U.S. Pat. No. 3,362,819. Examples of high molecular weight acid substances include copolymers of a vinyl monomer such as ethylene, vinyl acetate or vinyl methyl ether, etc. and maleic acid anhydride, n-butyl semiesters thereof, copolymer of butylacrylate and acrylic acid, and cellulose acetate acid phthalate. The neutralization layer may contain polymers such as polyvinyl acetate and plasticizers as described in U.S. Pat. No. 3,557,237 in addition to the above described acid substances. Further, the neutralization layer may be hardened by cross-linking reactions by means of polyfunctional aziridine compounds, epoxy compounds, etc. The neutralization layer is disposed in the dye image receiving component and/or the photosensitive component. It is particularly advantageous that it be positioned between the base and the image receiving layer in the dye image receiving component. The acid substances can be incorporated in the film unit as microcapsules, as described, for example, in German Patent Application (OLS) No. 2,038,254.

The neutralization layer or acidic substance containing layer in the above described case is preferred to be separated from the spread processing solution layer by a neutralization rate controlling layer (timing layer). This neutralization rate controlling layer has a function of retarding neutralization of the processing solution by the neutralization layer to sufficiently advance the desired development and transfer. The neutralization rate controlling layer is composed of polymers, for example, gelatin, polyvinyl alcohol, polyvinyl propyl ether, polyacrylamide, hydroxypropylmethyl cellulose, isopropyl cellulose, polyvinyl semibutyral, partially hydrolyzed polyvinyl acetate or $\beta$-hydroxyethyl methacrylate-ethyl acrylate copolymer, etc. as main ingredients. These polymers are preferred to be hardened by cross-linking reactions using aldehyde compounds such as formaldehyde or N-methylol compounds. Examples of the neutralization rate controlling layer have been described in U.S. Pat. Nos. 3,455,686, 4,009,030, 3,785,815, 4,054,722 and 4,123,275, Japanese Patent Application (OPI) Nos. 92022/73, 64435/74, 22935/74 and 77333/76, Japanese Patent Publication Nos. 15756/69, 12676/71 and 41214/73, German Patent Application (OLS) Nos. 1,622,936 and 2,162,277 and *Research Disclosure* 15162 No. 151 (1976). The neutralization rate controlling layer is preferred to have a thickness of from 2 microns to 20 microns.

It is preferred that the above described processing composition be used by putting it in a rupturable container as described in U.S. Pat. Nos. 2,543,181, 2,643,886, 2,653,732, 2,723,051, 3,056,491, 3,056,492 and 3,152,515, etc.

If the photographic element of the present invention is a film unit capable of carrying out photographic processing by passing it through a pair of processing members positioned in parallel after imagewise exposure to light, it comprises, for example, the following components:

(1) a base;

(2) a photosensitive component as described above;

(3) a dye image receiving component as described above;

(4) a processing component as described above; and (5) a developer (in the processing component or the photosensitive component).

A very preferred embodiment of a superposed unification type element for use in the present invention has been disclosed in Belgium Pat. No. 757,959. According to this embodiment, an image receiving layer, a substantially opaque light reflective layer (for example, a $TiO_2$ layer or a carbon black layer) and one or more of the above described photosensitive layers (photosensitive component) are applied in sequence to a transparent base, and a transparent cover sheet is superposed thereon so as to have a face-to-face relation. A destructible container filled with an alkaline processing composition containing a clouding agent for intercepting light (for example, carbon black) is disposed so as to be adjacent to the top layer of the above described photosensitive layer and to the transparent cover sheet. This film unit is exposed to light through the transparent cover sheet and the container is then destroyed by pressing members when the film unit is taken from the camera, by which the processing composition (containing the clouding agent) is spread between the photosensitive layer and the cover sheet. Thus the film unit is protected from light and the development advances in a light room.

In film units according to the foregoing embodiments, it is recommended in any case to employ the above described neutralization mechanism.

Particularly, it is preferred to provide the neutralization layer on the cover sheet (if necessary, a timing layer can be provided on the side on which the processing solution is spread).

Other useful unification type laminates capable of using a photographic element of the present invention have been described in U.S. Pat. Nos. 3,415,644, 3,415,645, 3,415,646, 3,647,487 and 3,635,707 and German Patent Application (OLS) No. 2,426,980.

In another preferred embodiment, an image receiving component having a laminar construction comprising base-neutralization layer-neutralization rate controlling layer-mordanting layer is superposed on a component having one or more photosensitive layers on a base (photosensitive component), and the above described alkaline processing solution is spread between both components for processing. In this case, the image receiving component may be separated after transfer of the dye image. On the other hand, if the base of the image receiving component is transparent, and a reflection layer is provided between the image receiving layer and the photosensitive layer, as described in U.S. Pat. No. 3,415,645, the image can be viewed without separating the image receiving layer.

The present invention will be illustrated in more detail by reference to the following examples.

EXAMPLE 1

The following layers were applied (in the described order) to a transparent polyethylene terephthalate film base to produce a photosensitive material.

(1) An image receiving layer containing 4.0 g/m$^2$ of copoly(styrene-N-vinylbenzyl-N,N,N-trihexyl ammonium chloride) and 4.0 g/m$^2$ of gelatin.

(2) A white reflection layer containing 22 g/m$^2$ of titanium dioxide and 2.2 g/m$^2$ of gelatin.

(3) An opaque layer containing 2.7 g/m$^2$ of carbon black and 2.7 g/m$^2$ of gelatin.

(4) A layer containing 0.50 g/m$^2$ of a cyan DRR compound represented by the structure

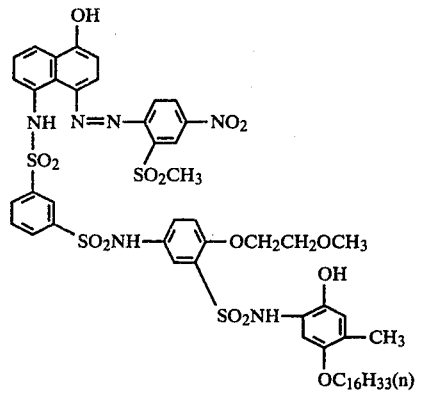

0.50 g/m$^2$ of N,N-diethyllaurylamide and 1.5 g/m$^2$ of gelatin.

(5) A layer containing a red-sensitive inner latent image type emulsion (gelatin 1.1 g/m$^2$, silver 1.4 g/m$^2$), 1-acetyl-2-[4-(2,4-di-t-pentylphenoxyacetamido)-phenyl)phenyl]hydrazine (0.015 g/m$^2$) and sodium 2-pentadecylhydroquinone-5-sulfonate (0.067 g/m$^2$).

(6) A stain preventing agent layer containing gelatin (1.0 g/m$^2$), 2,5-di-t-pentadecylhydroquinone (1.0 g/m$^2$) and tricresylphosphate (0.5 g/m$^2$).

(7) A layer containing a magenta DRR compound represented by the structure (0.80 g/m$^2$)

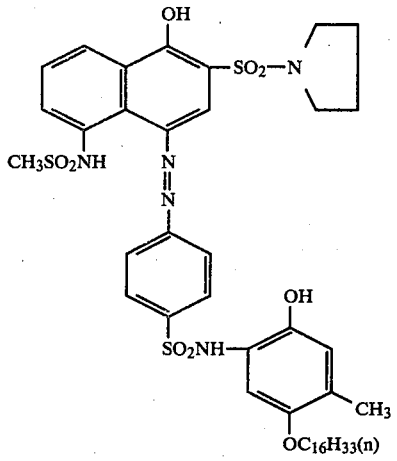

N,N-diethyllaurylamide (0.20 g/m$^2$) and gelatin (1.2 g/m$^2$).

(8) A layer containing a green-sensitive inner latent image type silver bromide emulsion (gelatin 1.1 g/m$^2$, silver 1.4 g/m$^2$), 1-acetyl-2-[4-(2,4-di-t-pentylphenoxyacetamido)phenyl]hydrazine (0.015 g/m$^2$) and sodium 2-pentadecylhydroquinone-5-sulfonate (0.067 g/m$^2$).

(9) A stain preventing agent layer containing gelatin (1.0 g/m$^2$), 2,5-di-t-pentadecylhydroquinone (1.0 g/m$^2$) and tricresylphosphate (0.5 g/m$^2$).

(10) A layer containing a yellow DRR compound represented by the structure (1.0 g/m$^2$)

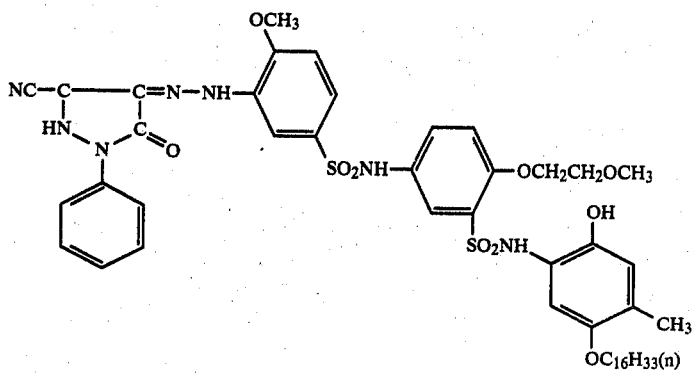

N,N-diethyllaurylamide (0.25 g/m$^2$) and gelatin (1.0 g/m$^2$).

(11) A layer containing a blue-sensitive inner latent image type silver bromide emulsion (gelatin 1.1 g/m$^2$, silver 1.4 g/m$^2$), 1-acetyl-2-[4-(2,4-di-t-pentylphenoxyacetamido)phenyl]hydrazine (0.015 g/m$^2$) and sodium 2-pentadecylhydroquinone-5-sulfonate (0.067 g/m$^2$).

(12) A protective layer containing 1.3 g/m$^2$ of gelatin, 0.9 g/m$^2$ of polyethyleneacrylate latex, 0.5 g/m$^2$ of Tinuvin (Registered trade mark for Alkylated 2-(2-hydroxyphenyl)-2H-benzotriazole manufactured and sold by Geigy AG) and 0.026 g/m$^2$ of triacryloyl perhydrotriazine as a hardener.

The above described coated material was imagewise exposed through a continuous filter using tungsten light of 2854° K. which was converted into light of 4800° K. by means of a Davis Gibson filter (the maximum exposure was 10 C.M.S.). The exposed film was developed with processing solutions having compositions as indicated below.

Processing composition A (Control)

| | |
|---|---|
| Potassium hydroxide | 56 g |
| 4-Hydroxymethyl-4-methyl-1-phenyl-3-pyrazolidinone | 13 g |
| 5-Methylbenzotriazole | 3.5 g |
| Methylhydroquinone | 0.24 g |
| Sodium sulfite | 0.2 g |
| Benzyl sulfite | 1.5 ml |
| Carboxymethyl cellulose | 5.8 g |
| Carbon black | 150 g |
| Water | to make 1 l |

Processing composition B

A composition having the same composition as in A except that 0.32 g of Compound (1): 2-isopropyl-5-methylhydroquinone was added instead of 0.24 g of methylhydroquinone.

Processing composition C (Control)

A composition having the same composition as in A except that 0.24 g of methylhydroquinone was removed.

Processing composition D

A composition having the same composition as in A except that 0.33 g of 2,5-dimethylhydroquinone was added instead of 0.24 g of methylhydroquinone.

Processing composition E

A composition having the same composition as in A except that 0.24 g of hydroquinone was added instead of 0.24 g of methylhydroquinone.

Processing composition F

A composition having the same composition as in A except that 0.40 g of t-butylhydroquinone was added instead of 0.24 g of methylhydroquinone.

On the other hand, a cover sheet was produced by applying the following layer in the described order to a transparent polyethylene terephthalate film base.

(1) A neutralization layer 7 microns thick containing 17 g/m$^2$ of polyacrylic acid, 0.06 g/m$^2$ of N-hydroxysuccinimidobenzene sulfonate and 0.50 g/m$^2$ of ethylene glycol.

(2) A timing layer obtained by applying cellulose acetate (oxidation value: 54) so as to be 2 microns thick.

(3) A timing layer obtained by applying a vinylidene chloride-acrylic acid copolymer latex so as to be 4 microns thick.

The above described processing compositions A to F were passed at 25° C. through a pair of rolls placed in parallel, by which they were uniformly spread between the photosensitive component and the cover sheet so as to have a thickness of 80μ.

After spreading the processing solution, the densities after 24 hours were measured, and the results are shown in the following table.

TABLE 1

| Processing composition | $D_{max}$ | | | $D_{min}$ | | | γ of the highlight portion | | |
|---|---|---|---|---|---|---|---|---|---|
| | B | G | R | B | G | R | B | G | R |
| A | 1.76 | 2.17 | 2.18 | 0.21 | 0.23 | 0.36 | 58.5 | 51.5 | 52.0 |
| B | 1.98 | 2.26 | 2.20 | 0.21 | 0.23 | 0.36 | 63.0 | 55.0 | 53.0 |
| C | 1.30 | 2.11 | 2.12 | 0.21 | 0.24 | 0.37 | 50.0 | 50.5 | 50.5 |
| D | 1.82 | 2.22 | 2.20 | 0.22 | 0.25 | 0.38 | 51.0 | 51.0 | 51.0 |
| E | 1.56 | 2.07 | 2.12 | 0.21 | 0.24 | 0.37 | 52.0 | 51.0 | 51.0 |
| F | 1.77 | 2.19 | 2.18 | 0.21 | 0.23 | 0.37 | 58.0 | 52.0 | 52.0 |

The value of γ of the highlight portion is shown by the unit mm which is a difference between (1) exposure (represented by logarithm) corresponding to maximum density (density corresponding to exposure: 1 CMS)+0.1 and (2) exposure (represented by logarithm) corresponding to minimum density, in the characteristic curve. For instance, 5 mm corresponds to an exposure of logarithm number: 0.1.

As can be understood from the above results, in the processing composition B of Example 1, to which 2-methyl-5-isopropylhydroquinone was added according to the present invention, the gradation of highlights hardens without reducing $D_{max}$ (maximum density) and very preferred gradation can be obtained.

EXAMPLE 2

On a transparent polyethylene terephthalate film base, an image receiving layer (1), a white reflection layer (2) and a carbon black containing opaque layer (3) were formed in the same way as Example 1, and a magenta DRR compound containing layer (7), a green-sensitive inner latent image type silver bromide emulsion layer (8), a stain preventing agent layer (9) and a protective layer (12) were applied thereto in the same way as Example 1.

The above described photosensitive material was processed by the same manner as in Example 1, using a processing solution as was used in Example 1. The results are as shown in Table 2.

TABLE 2

| Processing composition | G $D_{max}$ | G $D_{min}$ | γ of the high-light portion |
|---|---|---|---|
| A | 1.54 | 0.22 | 46.5 |
| B | 1.78 | 0.21 | 55.0 |
| C | 1.91 | 0.27 | 26.5 |
| D | 1.76 | 0.28 | 27.0 |
| E | 1.62 | 0.25 | 40.5 |
| F | 1.54 | 0.24 | 46.0 |

As can be understood from the above described results, in the processing composition B in Example 2 according to the present invention, gradation of highlights improves and very favorable gradation of the toe part can be obtained.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic element comprising (a) a photosensitive component containing at least one photosensitive silver halide emulsion layer combined with a DRR compound, (b) a dye image receiving component and (c) an alkaline processing composition component, wherein the improvement comprises at least one of said components (a), (b), and (c) containing a compound represented by the formula (I)

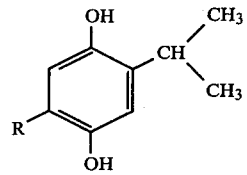

(I)

wherein R represents a substituted or unsubstituted alkyl group having from 1 to 18 carbon atoms.

2. A color diffusion transfer photographic element as in claim 1 wherein R represents a substituted or unsubstituted alkyl group having from 1 to 8 carbon atoms.

3. A color diffusion transfer photographic element as in claim 1 wherein R is selected from the group consisting of a methyl group, an ethyl group, a methoxyethyl group, an n-propyl group, an iso-propyl group, an allyl group, an n-butyl group, an iso-butyl group, a t-amyl group, an n-octyl group, a t-octyl group, an n-octadecyl group, an n-hexadecyl group, a sec-hexadecyl group, an n-pentadecyl group, an n-octadecyl group, and a sec-octadecyl group.

4. A color diffusion transfer photographic element as in claim 1, 2, or 3 wherein R is substituted by a member selected from the group consisting of a hydroxyl group, a halogen atom, a sulfone group, a carboxyl group, an amino group, an alkyloxy group, an alkylthio group, an aryloxy group, an arylthio group, a sulfonamido group, a sulfamoyl group, an alkylamido group, an aldehydo group and a 3,4-methylene-dioxyphenyl group.

5. A color diffusion transfer photographic element as in claim 1, 2, or 3 wherein the compound according to formula (I) is contained in alkaline processing composition component (c).

6. A color diffusion transfer photographic element as in claim 4 wherein the compound according to formula (I) is contained in alkaline processing composition component (c).

7. A color diffusion transfer photographic element as in claim 5 wherein the compound according to formula (I) is present in the alkaline processing composition component (c) at a concentration of from about 0.01 to 1 g/Kg of the processing composition.

8. A color diffusion transfer photographic element as in claim 6 wherein the compound according to formula (I) is present in the alkaline processing composition component (c) at a concentration of from about 0.01 to 1 g/Kg of the processing composition.

* * * * *